United States Patent [19]

Johne

[11] 4,258,326

[45] Mar. 24, 1981

[54] CAPACITIVE DETECTION OF ABSENT AND/OR DOUBLE SHEETS IN THE SHEET TRANSPORT PATH OF A PRINTING MACHINE

[75] Inventor: Albrecht Johne, Dresden, German Democratic Rep.

[73] Assignee: VEB Polygraph Leipzig, Kombinat für polygraphische Maschinen und Ausrustungen, Leipzig, German Democratic Rep.

[21] Appl. No.: 26,827

[22] Filed: Apr. 4, 1979

[30] Foreign Application Priority Data

Apr. 17, 1978 [DD] German Democratic Rep. ... 204812

[51] Int. Cl.[3] ..... H04B 7/14; H03K 17/90

[52] U.S. Cl. ..... 328/5; 271/258; 307/308; 340/562

[58] Field of Search ..... 328/5; 271/258, 63; 307/308; 340/675, 524, 562

[56] References Cited

U.S. PATENT DOCUMENTS

| | | | |
|---|---|---|---|
| 3,646,372 | 2/1972 | Shellman et al. | 340/675 |
| 3,898,472 | 8/1975 | Long | 340/562 |
| 3,948,510 | 4/1976 | Iwamoto et al. | 340/675 |

*Primary Examiner*—Stanley D. Miller, Jr.
*Assistant Examiner*—B. P. Davis
*Attorney, Agent, or Firm*—Michael J. Striker

[57] ABSTRACT

A detecting capacitive structure undergoes changes in capacitance value depending upon whether it is detecting, in the sheet transport path of a printing machine, a normal or single sheet, an absent sheet, or a double or stuck-together sheet, so that corrective action can be initiated, such as the skipping of a printing cycle. The detecting capacitive structure and also a reference capacitive structure constitute the capacitances of two RC circuit stages to which an input signal is applied and then removed. The variations with respect to time of the output signals from the two RC circuit stages are then compared, both during application of the input signal and subsequent to removal of the input signal. This comparison of time responses of the two RC circuit stages serves as the basis of the detection. The effect of the normal, absent or double sheet upon capacitance value is detected by monitoring a response dependent upon the time-constants of the RC circuit stages, without the detecting capacitive structure forming the capacitor of or resonant circuit.

12 Claims, 3 Drawing Figures

+Ub
u1
u2
u3
u4
u5
u6
u7
u8
u9
1
2
2'
3
4
5
6
7
8
9
10
11
12
13
14
15
16
20 u1
u2
u3
1
2''
4
13
17
18
19

CAPACITIVE DETECTION OF ABSENT AND/OR DOUBLE SHEETS IN THE SHEET TRANSPORT PATH OF A PRINTING MACHINE

BACKGROUND OF THE INVENTION

The present invention relates to the detection and recognition of absent and/or double sheets in the sheet transport paths of printing machines.

It is known in this art to employ capacitive sensing techniques to detect and distinguish between the presence of a single sheet in the sheet transport path, the absence of a sheet in such path, or the presence or two more improperly overlying or stuck-together sheets. For example, Federal Republic of Germany Patent No. 1,816,862 discloses the use of a sensing capacitor responsive to the dielectric character of the transported sheet material. The capacitance changes which the sensing capacitor undergoes in response to variations in the thickness of the sensed sheet material, i.e., due to the absence of the material or due to the improper presence of a double thickness of material, is evaluated in accordance with a technique which involves detuning or changing the resonance frequency of a resonant circuit of which the sensing capacitor forms a part.

The disadvantage of the various known capacitive measuring techniques conventionally employed in this art is that they do not really exhibit a level of accuracy high enough for reliable detection and discrimination of normal sheets, absent sheets, and double or multiple sheets. Furthermore, such systems, especially those which operate at high frequencies and rely upon high-frequency excitation for their operativeness per se, may often exhibit excessive levels of response and sensitivity to external interference or extraneous factors such as variations in sheet moisture content and so forth.

SUMMARY OF THE INVENTION

It is the general object of the present invention to provide an inherently more accurate capacitive system for detecting absent and/or double sheets in the transport path of a printing machine.

In accordance with the present invention, use is made of a reference capacitive structure, in addition to the detecting capacitive structure. The response of the detecting capacitive structure to electrical energization, this response being dependent upon the absence or presence of single or multiple sheets intermediate the electrodes of the detecting structure, is compared against the response of the reference capacitive structure to the same electrical energization, but with the reference capacitive structure not interacting with the sheet detected by the detecting capacitive structure.

Preferably, the detecting and reference capacitive structures are the capacitive components of respective first and second RC time-delay circuits, and a voltage is applied to the inputs of both time-delay circuits and then removed, in order that the capacitive structures of both time-delay circuits experience charge or discharge towards the applied voltage and then upon removal of the applied voltage discharge or charge back towards the original voltage across them. The rise and fall of the output voltage of the two time-delay circuits is then compared, one time-delay circuit against the other, and the discrepancy in the two circuits' time response to the input voltage forms the basis of the comparison and the basis of the detecting action.

For example, a well-defined rectangular voltage pulse can be applied to the inputs of both time-delay circuits, of duration not much greater than the time required for the capacitors of both circuits to charge up to the applied voltage, the capacitors discharging down to starting voltage, e.g., zero volts, upon termination of the applied voltage pulse. The rise and fall of the voltages across the two capacitors can then be compared, e.g., one output signal being generated and persisting so long as the rising voltage of one capacitor exceeds that of the other, and another output signal being generated and persisting so long as the falling voltage of one capacitor exceeds that of the other. This is a transient response, and accordingly has oscillatory implications to the extent that the time-constants of the two time-delay circuits are being relied on for the comparison and for the sheet-detecting action. However, the use of resonant circuitry per se is avoided. The inventive capacitive detecting technique accordingly does not make the detecting capacitive structure, nor the reference capacitive structure, a part of an resonant circuit.

According to a further concept of the invention, the system can distinguish between absent sheets and multiple sheets on the basis of whether the discrepancy in the time response of the two time-delay circuits is of one or the other polarity during the rise of the output signals of the two circuits or during the fall thereof. This will become clearer from the description of preferred embodiments below. Essentially, the distinction is made by ascertaining whether a discrepancy of predetermined polarity develops during the time the input voltage is applied or during the time subsequent to removal of the input voltage.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
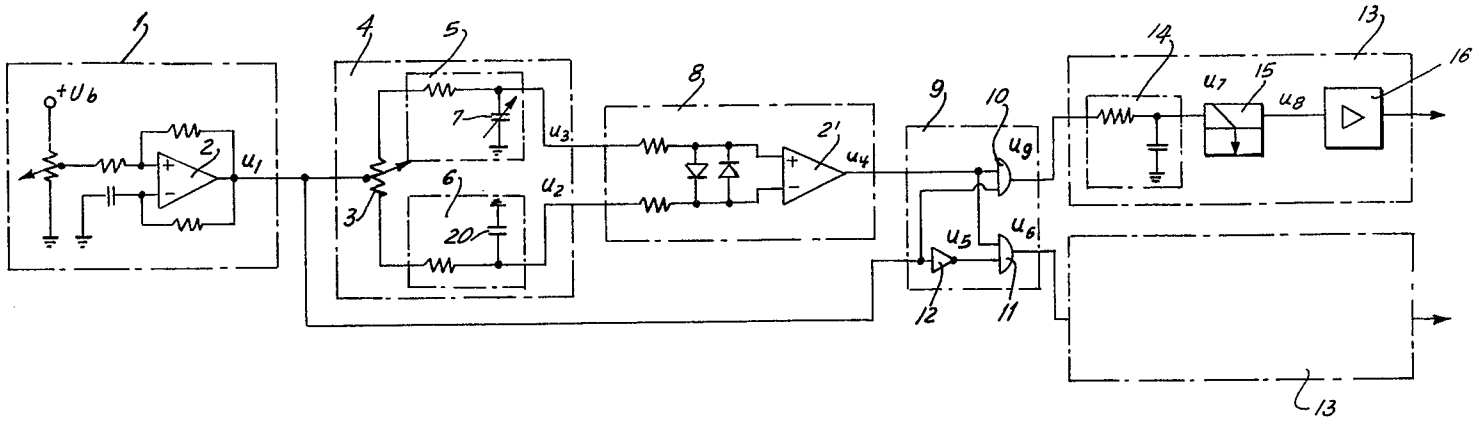
FIG. 1 depicts a first embodiment of the invention, capable of distinguishing among ordinary sheets, absent sheets and multiple sheets.

FIG. 1 depicts a preferred embodiment of the inventive capacitive sheet-detecting technique. A pulse generator 1 supplies the system with a pulsed exciting voltage $u_1$ (see FIG. 3). The pulse generator is of conventional type, comprised of an operational amplifier 2 connected to auxiliary components to act as an astable multivibrator.

The voltage pulse $u_1$ furnished by pulse generator 1 is applied via an input potentiometer 3 to the input of a twin time-delay stage 4 comprised of a first RC time-delay stage 5 and a second such stage 6, each having a time-constant T. The first time-delay stage 5 comprises the detecting capacitive structure 7 of the system, comprised in conventional manner of electrode structures through which, typically, the sheets being detected are transported. The second RC stage 6 serves as a reference stage and comprises a reference capacitor 20, preferably of the same construction as detecting capacitor 7.

The output signals $u_2$, $u_3$ (see FIG. 3) are applied to the two inputs of a comparator 8 comprised of an operational amplifier 2' connected to resistors and diodes in conventional manner for voltage-comparator action.

The output of comparator 8 and the output of pulse generator 1 are connected to respective ones of the two inputs of a phase evaluator 9. The latter comprises first and second AND-gates 10, 11 and an inverter 12. The lower inputs of both AND-gates 10, 11 are connected to the output of pulse generator 1, but via inverter 12 in the case of AND-gate 10, and their upper inputs to the output of comparator 8.

Each of the two outputs of phase evaluator 9 is connected to the input of a respective one of two evaluating circuits 13. Each evaluating circuit comprises a further RC stage 14 connected to act as an integrator, a Schmitt trigger 15 having a threshold voltage level $u_T$, and an amplifier 16. The output of each evaluating circuit 13 is connected to a respective input of the (non-illustrated) control system of the printing machine, e.g., to automatically prevent a printing operation in the absence of a detected sheet, or to initiate countermeasures correcting the situation such as involve various conventional techniques for inserting a sheet at the place of the absent sheet or causing a multiple sheet to separate into simple sheets.

When the need for high accuracy is not particularly great, the evaluating circuit 13 can be essentially comprised of the amplifier 16 alone.

When the need for high accuracy is very great, the circuit of FIG. 1 can be improved by incorporation of a Schmitt trigger intermediate the output of each RC stage 5, 6 and the respective input of voltage comparator 8. A further improvement in accuracy can be effected by connecting a high-precision monostable multivibrator at the input of the RC stage 14 of evaluating circuit 13; this serves to increase accuracy during the integrations performed by integrating RC stage 14 and accordingly suppress any interference pulses which might find their way into the circuitry.

Figure 2:
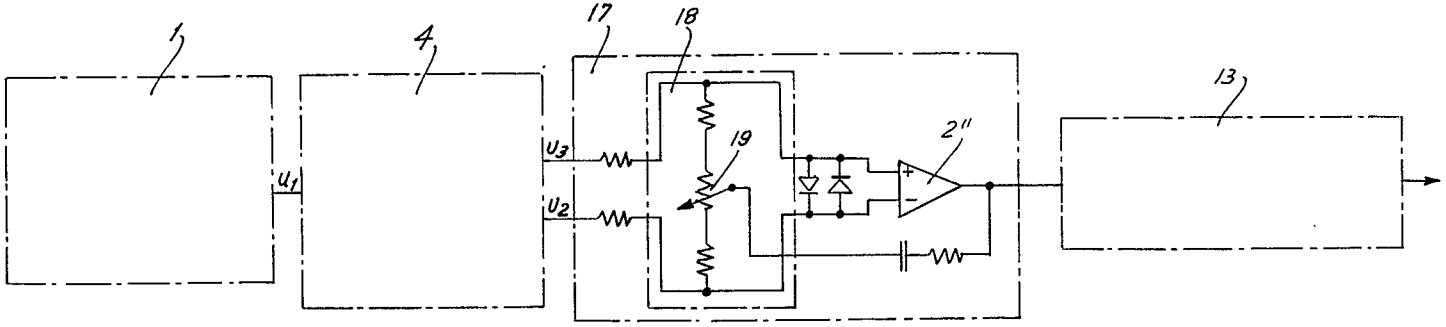
FIG. 2 depicts a simplified version of the embodiment depicted in FIG. 1, responding to both absent sheets and multiple sheets but not capable of distinguishing between them.

FIG. 2 depicts a simplified version of the embodiment shown in FIG. 1. The FIG. 2 embodiment can distinguish between a proper sheet, on the one hand, and absent or multiple sheets, on the other hand, but cannot distinguish between absent and multiple sheets; i.e., absent sheets and multiple sheets are here not differentiated from each other for control purposes. The pulse generator 1 and twin RC circuit stage 4 are the same as in FIG. 1, but the comparator 8 of FIG. 1 is replaced by a comparator 17. The latter comprises an operational amplifier 2'' connected to input diodes to act as a voltage comparator, but additionally having a feedback branch leading to the tap of a potentiometer 19 connected in series as part of a voltage-dividing adjustment stage 18. The output of comparator 17 is connected to the input of an evaluating circuit 13, e.g., such as shown in FIG. 1 or a simplified version thereof comprising essentially the amplifier 16 alone.

Figure 3:
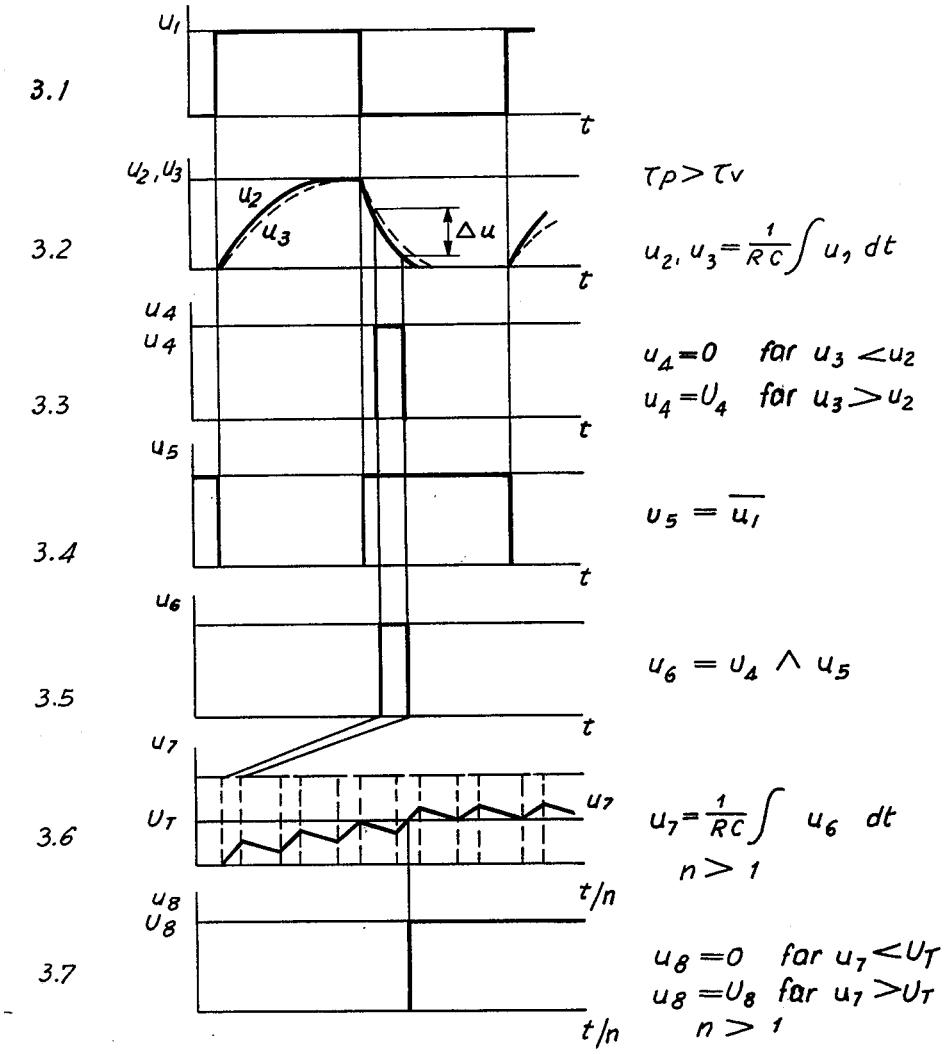
FIG. 3 is a set of voltage waveforms depicting the voltages $u_1$–$u_8$ at the outputs of eight different circuit stages in the circuit shown in FIG. 1.

The operation of the presently preferred embodiment shown in FIG. 1 will be described with respect to the voltage waveforms $u_1$ to $u_8$ shown in lines 3.1 to 3.7 of FIG. 3. FIG. 3 depicts the output voltage waveforms $u=f(t)$ at the outputs of various of the circuit stages in FIG. 1, for the case where a double sheet is being detected.

The pulse generator 1 furnishes a pulsed voltage $u_1$. When the twin RC stages 5, 6 have been properly set up, the time-constant $T_P$ of stage 5 and the time-constant $T_V$ of stage 6 are such that $$T_P = T_V.$$

The voltage pulse $u_1$ preferably has the steepest leading and trailing flanks feasible, preferably rising and falling in an interval at most equal to 1/100 of the time-constant of the two RC stages 5, 6. Likewise, the duration of the voltage pulse is preferably at least four times the time-constant of the two stages 5, 6, so that the two stages will have sufficient time to respond to the voltage pulse rather fully. The used of a voltage pulse for the comparison technique serves to considerably alleviate the potential difficulties associated with supply voltage fluctuations and fluctuations of the voltage pulses employed; in principle, however, it would for example be possible to operate using a sinusoidal voltage.

The voltage pulse $u_1$ is transmitted to the first and second RC stages 5, 6, which are preferably integrators, not differentiators.

When setting-up the system, the potentiometer 3 is adjusted with a normal, i.e., a single, sheet in the operative vicinity of detecting capacitive structure 7, until the output voltages $u_2$, $u_3$ of the two RC stages 5, 6 exhibit the same variation with respect to time, i.e., $u_2 = u_3 = f(t)$.

This initial adjustment can become unnecessary if, during operation of the system, a sheet or other sample of the stock to be detected, is kept located within the operative vicinity of the reference capacitor structure 20.

If, at the detecting station, there is not present a normal, i.e., single sheet, but instead the sheet is absent or a double, e.g., stuck-together, sheet is present, the capacitance of the detecting capacitive structure 7 undergoes a change relative to the value it has when a normal sheet is present, and this change results in an alteration of the time-constant of first RC stage 5. As a result, the time functions $u_2=f(t)$ and $u_3=f(t)$ become different from each other, and this fact is detected in the comparator 8.

The inverting input of the operational amplifier 2' within comparator 8 receives the output voltage waveform $u_2$ of second RC stage 6 as a reference voltage. When the measuring voltage $u_3$ at the non-inverting input of operational amplifier 2' is greater than the reference voltage $u_2$, comparator 8 produces an output signal $u_4$. If what is being detected is the absence of a sheet, then in the illustrated embodiment the comparator output signal $u_4$ is produced during the time of application of the voltage pulse $u_1$, because the time-constant of the first RC stage 5 is now smaller than that of the second RC stage 6. In contrast, if what is being detected is a double or multiple sheet, the comparator output signal $u_4$ is produced subsequent to removal of the voltage pulse $u_1$, because now the time-constant of the first RC stage 5 is greater than that of second RC stage 6. In the illustrated embodiment, a voltage pulse $u_1$ is applied to the inputs of the two RC stages 5, 6 repeatedly, so that here the comparator output signal $u_4$ develops for a double-sheet situation during the pause intermediate successive voltage pulses $u_1$.

These two situations are distinguished from each other in the phase comparator 9, which is operative for ascertaining, from the combined output signals of comparator 8 and of pulse generator 1, whether the comparator output pulse $u_4$ has been generated during a voltage pulse $u_1$ or during the interpulse interval intermediate successive voltage pulses $u_1$.

The AND-gate 10 produces an output signal $u_9$, when comparator 8 produces an output signal $u_4$ during the course of the applied voltage pulse $u_1$. This serves to indicate that a sheet is absent.

The AND-gate 11 generates a signal $u_6$, when the comparator 8 produces an output signal $u_4$ during an interval intermediate successive voltage pulses $u_1$, i.e., during the pulse $u_5=u_1$ produced at the output of inverter 12 during the interpulse interval of the pulses $u_1$. This indicates that a double sheet has been detected.

The output signals from phase evaluator 9 are transmitted to one or the other of the two evaluating circuits 13. Such output signal $u_6$ or $u_9$ is integrated by integrating RC stage 14, as shown at line 3.6 of FIG. 3, this integrating lasting over a plurality of successive periods of the voltage pulse $u_1$, until the integrated voltage $u_7$ exceeds the threshold voltage level $u_T$ of Schmitt trigger 15, whereupon the latter produces an output signal $u_8$ indicating the presence of an other-than-normal sheet situation, and the latter output signal is applied to an amplifier 16, and from there to the appropriate control units of the printing machine, e.g., to automatically effect the skipping of a printing cycle in order that, for example, an ink-covered cylinder not come into contact with a counterpressure cylinder due to the absence of a sheet, or the like.

As already stated, the simplified version of such circuit depicted in FIG. 2 is not capable of per se distinguishing between an absent-sheet and a double-sheet situation and will, in response to either situation, generate an output signal. The voltage pulse $u_1$ from the pulse generator 1 is applied to a comparator circuit 17. Comparator 17 comprises an operational amplifier 2'' connected to act as a voltage comparator and provided with a feedback branch extending from its output to the wiper of the potentiometer 19 of the adjustment voltage divider stage 18. The setting of potentiometer 19 serves to apply an adjustable biasing or reference voltage to the input circuitry of operational amplifier 2', as a result of which the measurement voltage $u_3$ itself in effect becomes suppressed.

It will be understood that each of the elements described above, or two or more together, may also find a useful application in other types of circuit configurations differing from the types described above.

While the invention has been illustrated and described as embodied in a system wherein both RC stages are integrating or time-delay stages in contrast to differentiator stages and wherein the applied voltage has the form of a rectangular pulse, it is not intented to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims:

1. In a detecting system of the type operative for detecting absent and/or multiple sheets in the sheet transport path of a printing machine and including a first RC circuit stage and a second RC circuit stage, a combination comprising a detecting capacitive structure forming the capacitance of the first RC circuit stage and operative for capacitively sensing normal, absent and multiple sheets; a reference capacitive structure forming the capacitance of the second RC circuit stage; means for applying an electrical signal to said detecting capacitive structure and to said reference capacitive structure, said applying means including means operative for applying a voltage pulse to the inputs of the first RC circuit stage and the second RC circuit stage; and comparator circuit means connected to said detecting capacitive structure and said reference capacitive structure, said comparator circuit means including means operative for comparing the response with respect to time exhibited by both RC circuit stages in response to application of said pulse and also the response with respect to time exhibited by the first RC circuit stage and the second RC circuit stage subsequent to termination of the pulse whereby a signal is generated, which signal indicates whether a normal or an absent or multiple sheet is being detected.

2. In a detecting system as defined in claim 1, the RC circuit stages each being of integrating or time-delay circuit configuration.

3. In a detecting system as defined in claim 1, the comparator circuit means comprising means operative during the response of the two RC circuit stages both to the application of the pulse and the termination of the pulse for generating a comparator output signal when the output voltage of a predetermined one of the two RC circuit stages is greater than that of the other.

4. In detecting system as defined in claim 3, furthermore including means receiving the comparator output signal and operative for generating a first signal if the comparator output signal is produced during application of the voltage pulse to the two RC circuit stages and operative for generating a distinguishable second signal if the comparator output signal is produced subsequent to termination of the voltage pulse.

5. In a detecting system as defined in claim 4, the means generating said first and second signal comprising first and second AND-gates and an inverter, a first input of each AND-gate being connected to receive the comparator output signal, a second input of one of the AND-gates being connected to the output of the means applying the voltage pulse, a second input of the other of the AND-gates being connected to the output of the inverter, the input of the inverter being connected to the output of the means applying the voltage pulse.

6. In a detecting system as defined claim 1, furthermore including variable resistance means connected between the means for applying the voltage pulse and the inputs of the two RC circuit stages.

7. In a detecting system as defined in claim 6, the variable resistance means comprising a potentiometer having a wiper electrically connected to the means for applying the voltage pulse and two output terminals connected to the inputs of respective ones of the two RC circuit stages.

8. In a detecting system as defined in claim 1, the comparator circuit means comprising an operational-amplifier comparator circuit.

9. In a detecting system as defined in claim 1, furthermore including evaluating circuit means having an input connected to the output of the comparator circuit means and comprising an amplifier.

10. In a detecting system as defined in claim 9, the evaluating circuit means furthermore including an RC circuit stage of integrating circuit configuration having an input connected to the output of the comparator circuit means, a Schmitt trigger having an input connected to the output of the last-mentioned RC circuit stage, the amplifier having an input connected to the output of the Schmitt trigger.

11. In a detecting system as defined in claim 1, the voltage pulse having rise and fall times and a pulse duration respectively equal to at most about 1/100 and equal to at least about four times the times-constants of the two RC circuit stages.

12. In a detecting system as defined in claim 1, the comparator circuit means comprising an operational amplifier having inverting and non-inverting inputs, an adjustable voltage divider having two terminals connected to receive respective ones of the output signals of the two RC circuit stages and connected to respective ones of the inverting and non-inverting inputs of the operational amplifier, the adjustable voltage divider furthermore having a tap, furthermore including a feedback branch connected between the output of the operational amplifier and the tap of the adjustable voltage divider.

* * * * *